US008419365B2

(12) United States Patent
Kizuka et al.

(10) Patent No.: US 8,419,365 B2
(45) Date of Patent: Apr. 16, 2013

(54) MEMBER HAVING INTERNAL COOLING PASSAGE

(75) Inventors: Nobuaki Kizuka, Hitachinaka (JP); Yasuhiro Horiuchi, Hitachinaka (JP); Shinya Marushima, Hitachinaka (JP); Hidetoshi Kuroki, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 13/093,400

(22) Filed: Apr. 25, 2011

(65) Prior Publication Data

US 2011/0200449 A1 Aug. 18, 2011

Related U.S. Application Data

(63) Continuation of application No. 11/395,310, filed on Apr. 3, 2006, now Pat. No. 7,980,818.

(30) Foreign Application Priority Data

Apr. 4, 2005 (JP) ..... 2005-107005

(51) Int. Cl.
*F01D 5/18* (2006.01)

(52) U.S. Cl.
USPC ..... 416/96 R; 416/97 R; 415/115

(58) Field of Classification Search ..... 415/115, 415/116, 96 R, 97 R, 97 A, 90 R
See application file for complete search history.

(56) References Cited

U.S. PATENT DOCUMENTS

| | | | |
|---|---|---|---|
| 4,514,144 | A | 4/1985 | Lee |
| 5,395,212 | A | 3/1995 | Anzai et al. |
| 6,142,734 | A | 11/2000 | Lee |
| 6,227,804 | B1 | 5/2001 | Koga et al. |
| 6,612,808 | B2 | 9/2003 | Lee et al. |

FOREIGN PATENT DOCUMENTS

| | | |
|---|---|---|
| JP | 02223602 | 9/1990 |
| JP | 5-10101 | 1/1993 |
| JP | 11241602 | 9/1999 |
| JP | 3006174 | 11/1999 |
| JP | 2000-282804 | 10/2000 |

OTHER PUBLICATIONS

Japanese Office Action mailed Sep. 21, 2010 in counterpart Japanese Patent Application No. 2006-096367 with English language translation.

Japanese Office Action mailed Mar. 8, 2011 in counterpart Japanese Patent Application No. 2006-096367 with English language translation.

Japanese Office Action mailed Aug. 21, 2012 in counterpart Japanese Patent Application No. 2011-188158 with English language translation.

*Primary Examiner* — Dwayne J White
(74) *Attorney, Agent, or Firm* — Brundidge & Stanger, P.C.

(57) ABSTRACT

Provided is a member having an internal cooling passage 7*c* formed therein and having opposed partition walls 6*b*, 6*c* between which a medium flows to cool a parent material, including a first heat transfer rib 25*a* which extends from almost the center between the opposed partition walls 6*b*, 6*c* to one partition wall 6*c* and slants in a downstream direction of the medium, and a second heat transfer rib 25*b* which extends from almost the center between the opposed partition walls 6*b*, 6*c* to the other partition wall 6*b* and slants in the downstream direction of the medium, wherein a slit 70*a* or 70*b* which passes through between an upstream side of the cooling passage 7*c* and a downstream side thereof is formed in the first heat transfer rib 70*a* or the second heat transfer rib 70*b*.

9 Claims, 13 Drawing Sheets

MEMBER HAVING INTERNAL COOLING PASSAGE

This application is a continuation application of U.S. application Ser. No. 11/395,310 filed Apr. 3, 2006, and claims priority from Japanese Patent Application No. 2005-107005, filed Apr. 4, 2005, the entirety of which are incorporated herein by reference.

BACKGROUND OF THE INVENTION

1. Field of the Invention

The present invention relates to improvement of a member having an internal cooling passage, and more particularly, to improvement of a member having an internal cooling passage with a wall surface which possesses cooling ribs.

2. Description of Related Art

In the related art, for improvement of heat transfer efficiency in an internal cooling passage of a member, a method of causing turbulence flow in air flow of a heat transfer surface or destroying a boundary layer is known. In addition, there is a method of providing a plurality of protrusions on a blade.

For example, in JP-A-05-10101 (U.S. Pat. No. 5,395,212; FIG. 3), a plurality of ribs is provided in the internal cooling passage of a member and arranged in a staggered manner with respect to flow of a medium in the cooling passage such that turbulent flow is caused in the medium on a heat transfer surface to obtain a large cooling heat transfer coefficient.

In addition, in JP-A-2000-282804 (FIG. 10), there is disclosed a cooling passage in which ribs arranged in a staggered manner are divided and ribs at the side of wall surfaces are arranged at an upstream side of a medium.

SUMMARY OF THE INVENTION

In JP-A-05-10101, the medium near the ribs flows as shown in FIG. 9, but a large recirculation zone 57 which does not contribute to the heat transfer exists at a rear side of the rib, that is, at a downstream side of the rib. Thus, heat transfer performance of the whole member may deteriorate.

Meanwhile, in JP-A-2000-282804, since the ribs are only divided and the reduction of the recirculation zone at the downstream side of the rib is not considered, an interval between the divided rib pieces is large. In other words, since the medium flows directly through an opening, it is judged that the recirculation zone exists at the downstream side of the rib pieces at the side of the wall surface.

It is desirable to provide a member having high heat transfer performance by reducing a recirculation zone at a downstream side of a rib.

According to the present invention, there is provided a member having an internal cooling passage formed therein and having opposed wall surfaces between which a medium flows to cool a parent material, including a first rib which extends from almost the center between the opposed wall surfaces to one wall surface and slants in a downstream direction of the medium, and a second rib which extends from almost the center between the opposed wall surfaces to the other wall surface and slants in the downstream direction of the medium, wherein an opening which passes through between an upstream side of the cooling passage and a downstream side thereof is formed in the first rib or the second rib.

According to the present invention, it is possible to provide a member having high heat transfer performance by reducing a recirculation zone at a downstream side of a rib.

DESCRIPTION OF THE PREFERRED EMBODIMENTS

There are provided various members which each have an internal cooling passage formed therein and having opposed wall surfaces between which a medium flows to cool a parent material. However, here, for example, a most representative gas turbine blade will be described.

A general gas turbine is configured to obtain high temperature and high pressure gas generated by the combustion of fuel with high pressure air compressed by a compressor to drive a turbine. Rotation energy of the driven turbine is generally converted to air energy by a generator coupled to the turbine.

Here, since a part of a high temperature section of the gas turbine, and more particularly, a heat load of a blade becomes higher, the blade has an internal cooling passage. Concretely saying, a cavity is provided in the blade to be used as the cooling passage and gas discharged or extracted from the compressor is fed into the cooling passage to cool the blade to an allowable temperature or less.

Hereinafter, embodiments of the present invention will be described with reference to the attached drawings.

Figure 1:
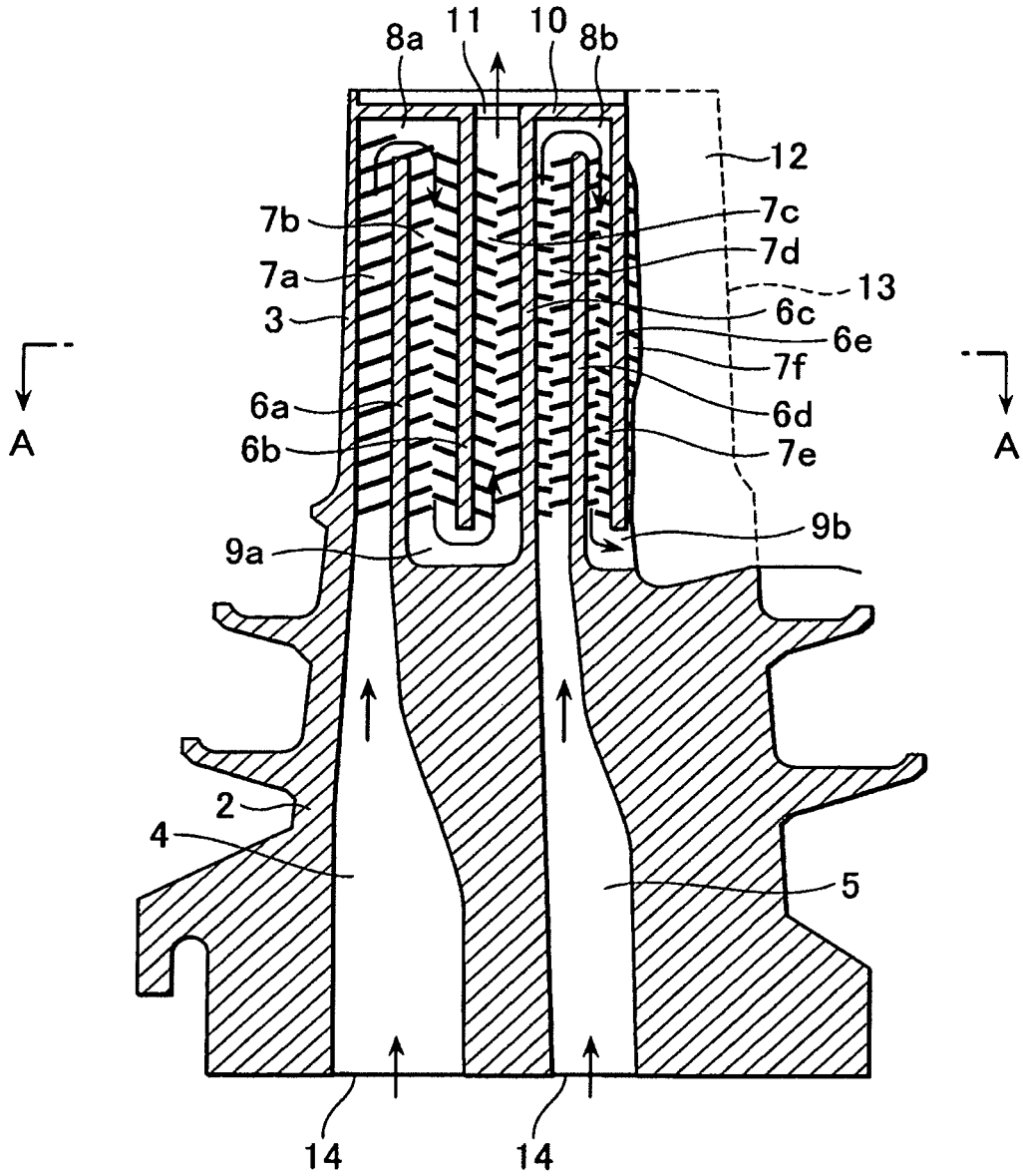
FIG. 1 is a longitudinal cross-sectional view showing a structure of a turbine blade according to a first embodiment of the present invention.

FIG. 1 is a longitudinal cross-sectional view showing a structure of a member, that is, a gas turbine blade 1, according to a first embodiment of the present invention. The gas turbine blade 1 has a plurality of internal passages 4 and 5 from the inside of a shank portion 2 to the inside of a blade portion 3.

In the blade portion 3, the passages 4 and 5 are divided into a plurality of internal cooling passages 7*a*, 7*b*, 7*c*, 7*d*, 7*e*, and 7*f* by a plurality of partition walls 6*a*, 6*b*, 6*c*, 6*d*, and 6*e*, and form a return flow passage including top end bending portions 8*a* and 8*b* and lower end bending portion 9*a* and 9*b*. In other words, in the present embodiment, the first passage 4 includes the cooling passage 7*a*, the top end bending portion 8*a*, the cooling passage 7*b*, and the lower end bending portion 9*a*, and the cooling passage 7*c*. In addition, the second passage 5 includes the cooling passage 7*d*, the top end bending portion 8*b*, the cooling passage 7*e*, and the lower end bending portion 9*b*, the cooling passage 7*f*, and a blowout hole 13 provided at a blade trailing edge 12.

Cooling medium such as cooling air is supplied from a rotor disc (not shown in the figure), on which the turbine blade 1 is installed, to the air flow inlet 14, and cools the blade from the inside while passing through the internal passage 4. After cooling the blade, the air flow is blown off into the main operating gas through a blowout hole 11 provided at the top end wall 10 of the blade and the blowout hole 13 provided at the blade trailing edge 12.

The ribs for improvement of heat transfer according to the present invention are integrally provided on the cooling wall surfaces of the cooling passages 7*b*, 7*c*, 7*d*, and 7*e*. The ribs for improvement of the heat transfer or heat transfer ribs are formed in a special shape slanting to a flow direction of cooling air in the cooling passages.

Figure 2:
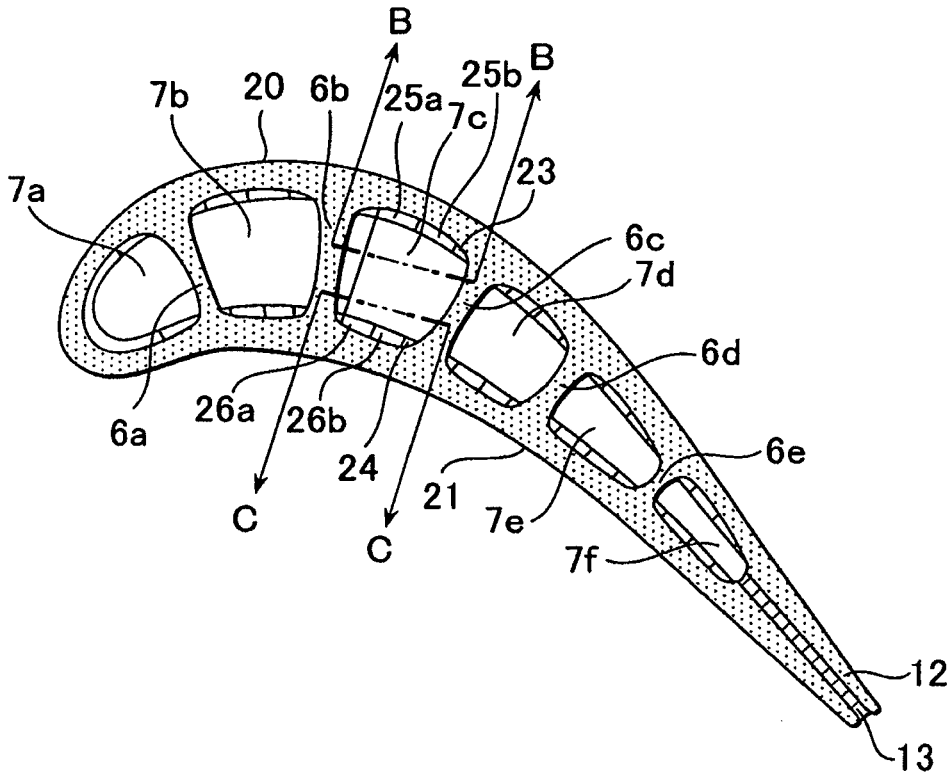
FIG. 2 is a cross-sectional view of the turbine blade take along line A-A of FIG. 1.

Next, as shown in FIG. 2 which is a cross-sectional view of the turbine blade 1 taken along line A-A of FIG. 1, the cooling passages 7*a*, 7*b*, 7*c*, 7*d*, 7*e* and 7*f* are defined by a blade suction side wall 20, a blade pressure side wall 21, and the partition walls 6*a*, 6*b*, 6*c*, 6*d*, and 6*e* to constitute a blade portion 3. For instance, the cooling passage 7*c* is composed of the blade suction side wall 20, the blade pressure side wall 21, and the partition walls 6*b* and 6*c*. The shape of the above-described cooling passage differs depending on the design, and the shape could be a trapezoid, rhombus, or rectangle. The ribs 25*a* and 25*b* for improvement of the heat transfer, which are formed integrally with the blade suction side wall 20, are provided on a back side cooling surface 23 of the cooling passage 7*c*. The ribs 26*a* and 26*b* for the improvement of the heat transfer, which are formed integrally with the blade pressure side wall 21, are provided on a front side cooling surface 24.

Figure 3:
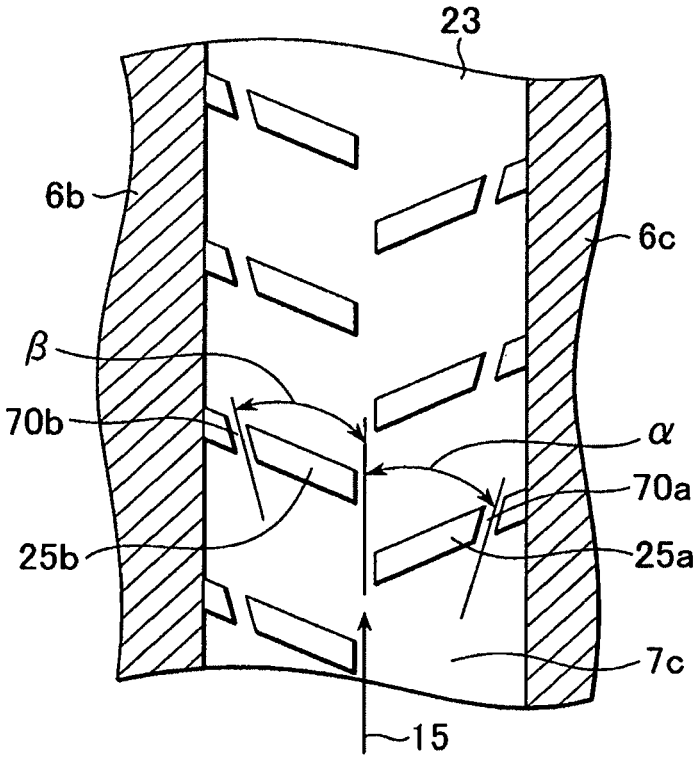
FIG. 3 is a cross-sectional view of a cooling passage taken along line B-B of FIG. 2.

For example, the blade suction side wall 20 will be described with reference to FIG. 3 which is a cross-sectional view of the cooling passage 7*c* taken along line B-B of FIG. 2. As shown in FIG. 3, the cooling passage 7*c* has the first heat transfer rib 25*a* which extends from almost the center between the opposed wall surfaces to one wall surface and slants in a downstream direction of the cooling air and the second heat transfer rib 25*b* which extends from almost the center between the opposed wall surfaces to the other wall surface and slants in the downstream direction of the cooling air. An opening which passes through between an upstream side of the cooling passage 7*c* and a downstream side thereof is formed in the first rib 25*a* or the second rib 25*b*. In addition, the ribs 25*a* and 25*b* of the back side cooling surface 23 are alternately arranged at the right and left sides from almost the center of the back side cooling surface 23 in a staggered manner and with different angles to the flow direction 15 of the cooling air. In addition, the openings provided in the ribs 25*a* and 25*b* are composed of slits 70*a* and 70*b* at a predetermined angle to the flow direction 15 of the cooling air. Although the cooling passage 7*c* in which the cooling air flows to the upstream side (upper side of FIG. 1) is described, the same is true in the cooling passage in which the cooling air flows to the downstream side).

Figure 4:
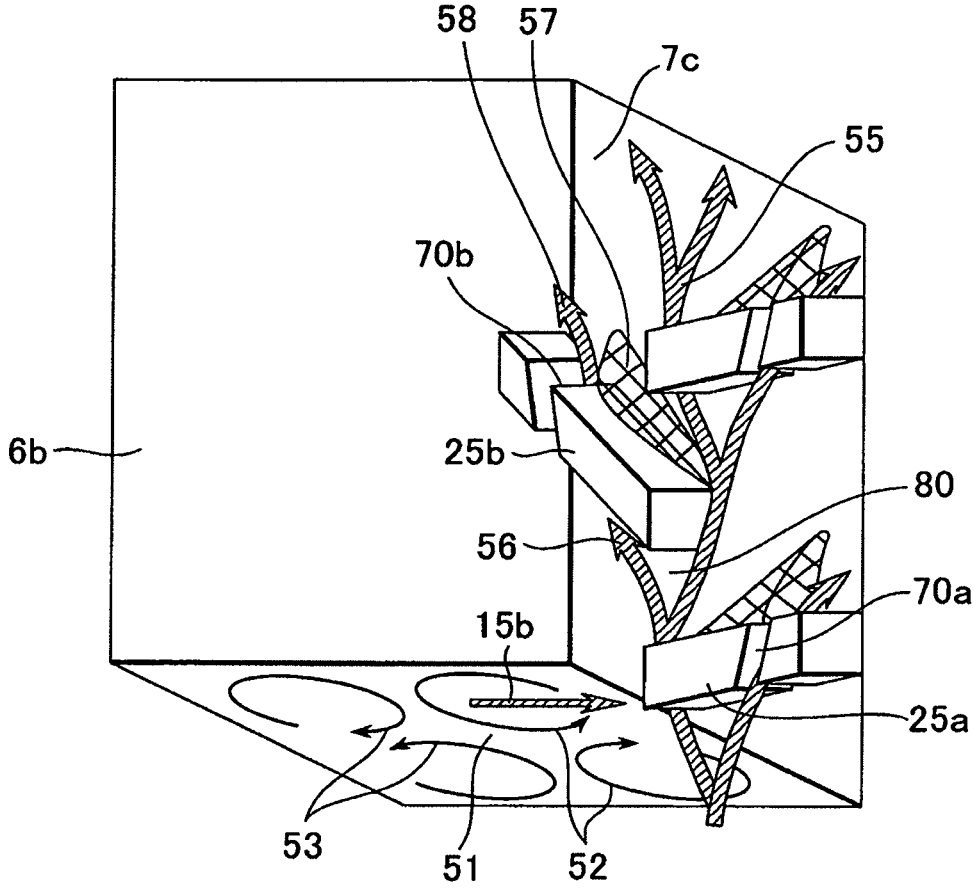
FIG. 4 shows air flow in the cooling passage of FIG. 3.

Next, the cooling air flow near the ribs 25*a* and 25*b* in the cooling passage 7*c* will be described, using FIG. 4. In addition, in FIG. 4, the ribs provided on the opposed wall surfaces are not shown.

Two pairs of secondary flows 52 and 53 are generated to be apart from a rib mounting surface in the vicinity of the partition wall 6*b* which is a side wall of the cooling passage 7*c* and to be directed to the rib mounting surface in the center 51 of the passage. In addition, in the vicinity of the rib mounting surface, snaking flow 55 which runs in a space 80 between the ribs 25*b* and 25*a* and flow 56 which is directed to the partition wall 6*b* along the upstream side of the rib 25*b* are formed. Furthermore, since air 15*b* having a low temperature in the center 51 of the passage becomes a turbulence flow caused by the snaking flow 55 by the secondary flow 52, heat transfer performance increases in the vicinity of the center of the rib mounting surface.

Since the slits 70*b* and 70*a* are provided in the ribs 25*a* and 25*b*, a portion 58 of the flow 56 which is directed to the partition walls 6*b* and 6*c* along the upstream side of the ribs 25*a* and 25*b* flows through the slits 70*b* and 70*a* and is deflected to the partition wall 6*b* and 6*c* to reach the downstream side which is the rear side of the ribs 25*b* and 25*a*, thereby reducing a recirculation zone 57. At the result, the heat transfer coefficient is more improved and heat efficiency of the gas turbine more increases, in comparison with the ribs 25*b* and 25*a* without the slit 70*b* and 70*a*.

In addition, the flow 56 which is directed to the partition walls 6*b* and 6*c* collides with the partition walls 6*b* and 6*c* to jump back. At this time, large pressure loss occurs. However, in the present embodiment, since the portion 58 of the flow which is directed to the partition walls 6*b* and 6*c* passes through the slits 70*b* and 70*a*, collision with the partition walls 6*b* and 6*c* can be reduced and thus the pressure loss can be reduced.

When the formation angles $\alpha$ and $\beta$ of the slits 70*a* and 70*b* are equal to or greater than 45 degrees, the flow vector of the air which flows though the slits 70*a* and 70*b* and is directed to the partition walls 6*b* and 6*c* is amplified to generate the pressure loss. Thus, it is preferable that the formation angles $\alpha$ and $\beta$ of the slits 70*a* and 70*b* are in a range of 0 degree to 45 degrees. In addition, since the heat transfer coefficient in the vicinity of the partition walls 6*b* and 6*c* is lower than that in the vicinity of the center of the rib mounting surface, the slits 70*b* and 70*a* are more preferably provided in the vicinity of the partition walls 6*b* and 6*c* rather than the center of the ribs 25*b* and 25*a*.

Furthermore, according to the present embodiment, efficient turbulence flow is caused in the cooling air flow in the cooling passage provided in the member such it is possible to cool the turbine blade with a smaller quantity of air. In other words, since it is possible to reduce the quantity of the cooling air discharged or extracted from the compressor and to sufficiently ensure the air for the consumption, the heat efficiency of the gas turbine is improved.

In particular, in a combination cycle of a gas turbine and a hot air turbine, higher temperature and higher pressure operating gas may be used. In addition, even in a high moisture gas turbine (HAT) generating plant which accomplishes high efficiency by adding moisture to operating gas, the heat load of the blade is high. Accordingly, when the high moisture operating gas is used, the present embodiment is more efficient.

Figure 5:
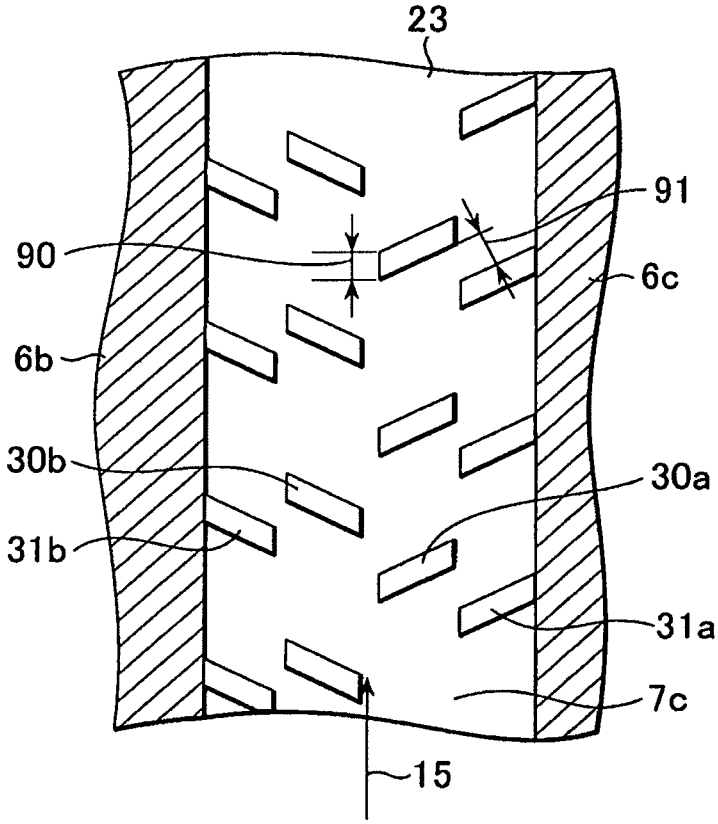
FIG. 5 is a cross-sectional view of a cooling passage according to a second embodiment of the present invention.

FIG. 5 is a cross-sectional view of the cooling passage 7*c* according to a second embodiment of the present invention and corresponds to FIG. 3 of the first embodiment. In the present embodiment, for example, the blade suction side wall 20 will be described. Unlike the first embodiment, the first rib and the second rib are divided into a plurality of rib pieces, and the rib pieces 31*b* and 31*a* at the sides of the partition walls 6*b* and 6*c* are displaced from the other rib pieces 30*b* and 30*a* toward the upstream side of the cooling air.

Figure 6:
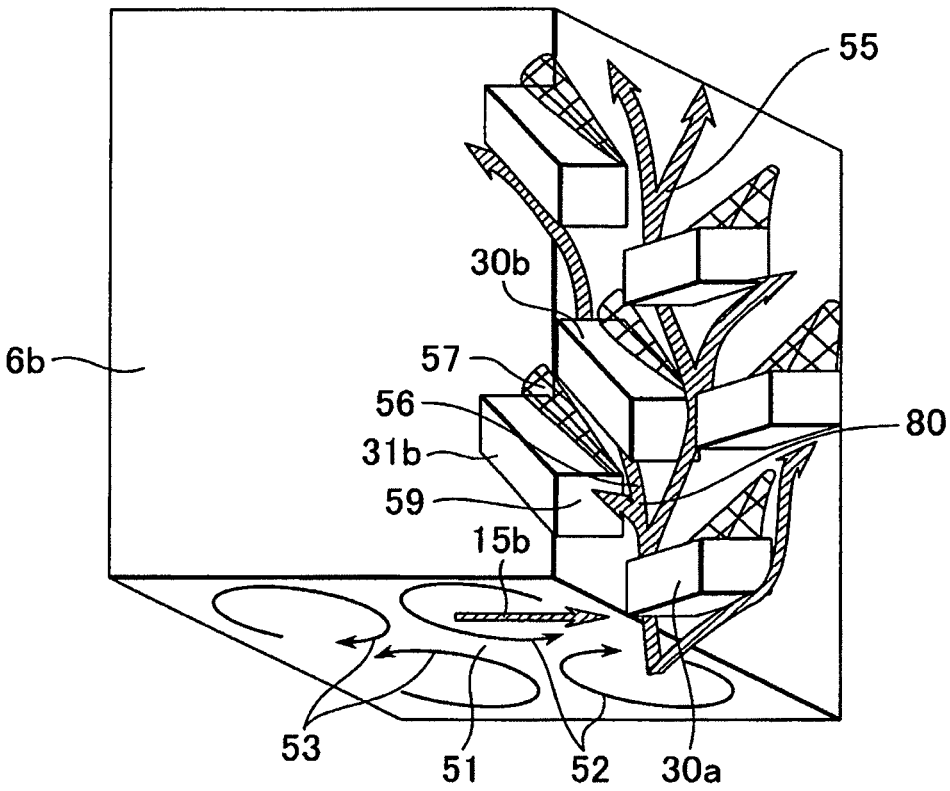
FIG. 6 shows air flow in the cooling passage of FIG. 5.

Next, the cooling air flow in the vicinities of the rib pieces 30*a*, 30*b*, 31*a*, and 31*b* in the cooling passage 7*c* according to the present embodiment will be described with reference to FIG. 6. In addition, in FIG. 6, the ribs provided on the opposed wall surfaces are not shown.

In the present embodiment, since the ribs are divided, flow 56 which is directed to the partition walls 6*b* and 6*c* along the upstream side of the rib collides with edges 59 which are ends of the rib pieces 31*b* and 31*a* at the side of the partition walls 6*b* and 6*c* to improve the heat transfer. In addition, the cooling air colliding with the edges 59 flows through the openings between the plurality of divided rib pieces and is directed to the downstream side which is the rear sides of the rib pieces 31*b* and 31*a* at the sides of the partition walls 6*b* and 6*c*. Then, the recirculation zone 57 is reduced, the heat transfer coefficient is improved and thus the heat efficiency of the gas turbine can increase.

More preferably, the width 91 of the opening formed by the divided rib pieces is in a range of 0.5 times to 1.5 times of the width 90 of the rib piece. When the width 91 of the opening is restricted as described above, the flow is extracted due to extremely large width 91 of the opening. Thus, sufficient heat transfer effect due to collision is obtained.

Figure 9:
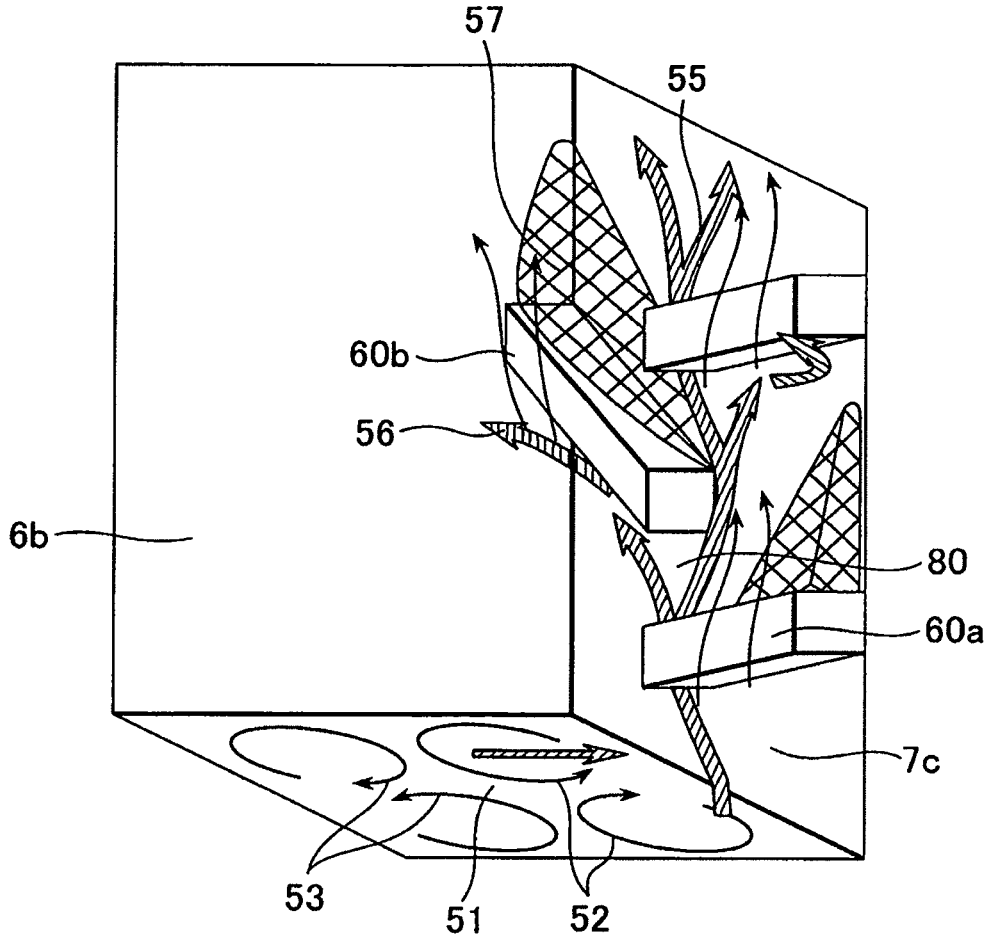
FIG. 9 shows air flow in a cooling passage in the related art.

Model heat transfer experiments on the ribs in the related art shown in FIG. 9, the ribs of the first embodiment, and the ribs of the second embodiment were performed. Concretely saying, the heat transfer effects were compared under the shapes of the experimental models and experimental conditions shown in Table 1.

TABLE 1

| | ITEM | RELATED ART | FIRST EMBODIMENT | SECOND EMBODIMENT |
|---|---|---|---|---|
| RIB SHAPE | RIB HEIGHT | 4.9 mm | 4.9 mm | 4.9 mm |
| | RIB WIDTH | 4.9 mm | 4.9 mm | 4.9 mm |
| | RIB PITCH | 24.5 mm | 24.5 mm | 24.5 mm |
| | RIB ANGLE | γ 70° | γ 70° | γ 70° |
| | SLIT OR DIVISION ANGLE | — | 20° | 0° |
| | SLIT WIDTH | — | 4 mm | DIVISION |
| | PASSAGE WIDTH | 70 mm | 70 mm | 70 mm |
| | PASSAGE HEIGHT | 70 mm | 70 mm | 70 mm |
| EXPERIMENTAL CONDITIONS | MEDIUM | AIR | AIR | AIR |
| | EXPERIMENTAL RANGE (REYNOLDS NUMBER) | $3\sim6.5\times10^4$ | $3\sim6.5\times10^4$ | $3\sim6.5\times10^4$ |

In the experimental models, a rectangular passage having a passage height of 70 mm and a passage height of 70 mm was formed, the ribs shown in Table 1 were arranged on two opposed surfaces, air having a normal temperature flowed in the model passage, and one of the opposed surfaces was heated, and a temperature distribution of the heated surface was measured, thereby measuring the heat transfer coefficient.

Figure 7:
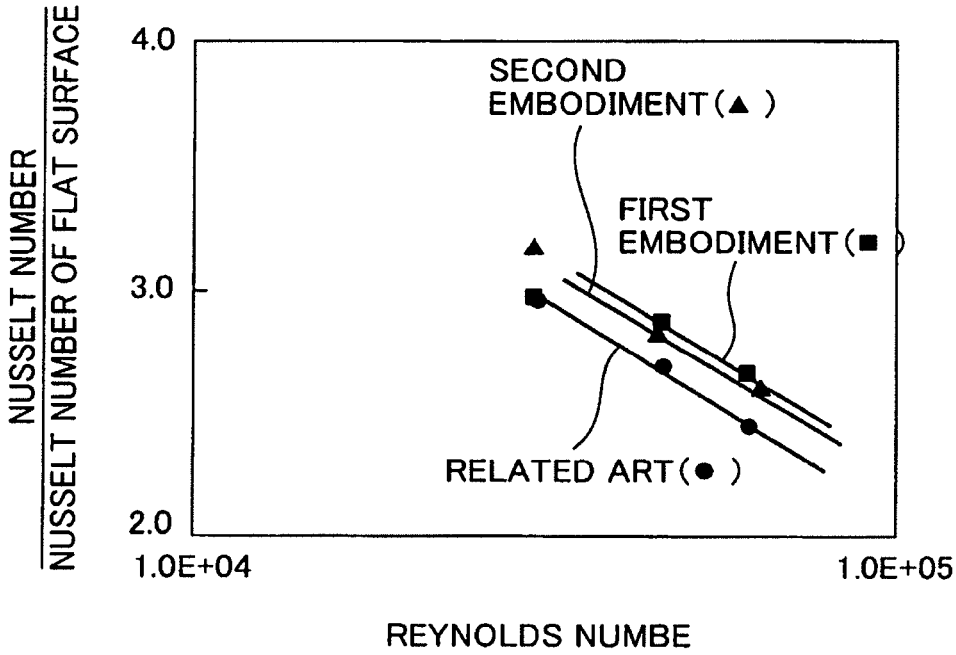
FIG. 7 shows experimental results of heat transfer characteristics.

FIG. 7 shows experimental results of heat transfer characteristics. The comparison was performed with the abscissa indicating the Reynolds numbers which express flow condition of the cooling air and the ordinate indicating a ratio of an average Nusselt number which expresses the flow condition of heat and an average Nusselt number of a flat surface. In FIG. 7, the larger the value on the ordinate, the more preferable the cooling performance is. In FIG. 7, the heat transfer performances of the structures relating to the first embodiment and the second embodiment are clearly more preferable in comparison with the structure in the related art. Under the condition of Reynolds number of $6.5\times10^4$, which is close to the cooling air supply condition in rated gas turbine operation, the structures relating to the first embodiment and the second embodiment have the higher heat transfer coefficient by about 8% and 6% in comparison with the related art, respectively.

In other words, when the ribs are configured by the first embodiment or the second embodiment, it is possible to obtain higher heat transfer efficiency. Accordingly, it is possible to efficiently cool the member with a smaller quantity of cooling air.

Figure 8:
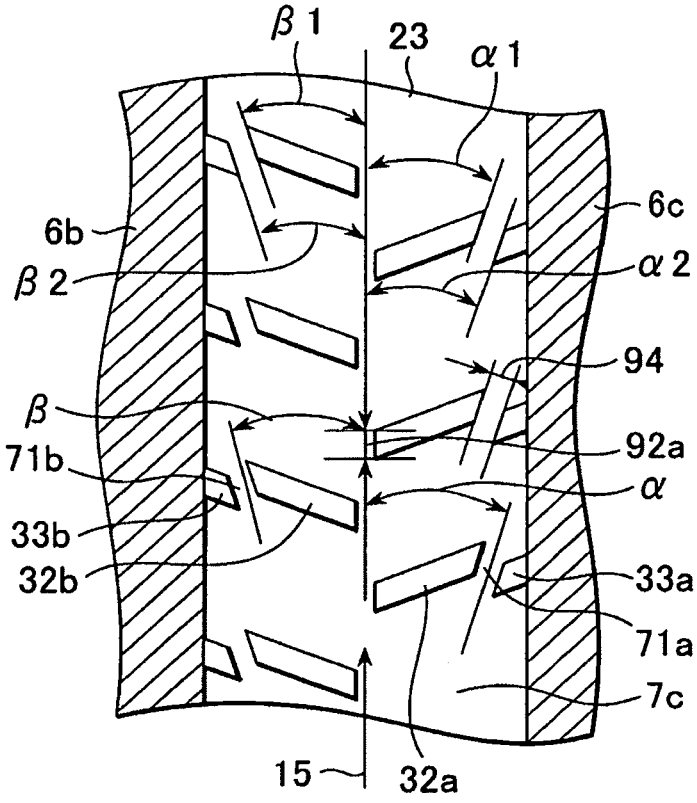
FIG. 8 is a cross-sectional view of a cooling passage according to a third embodiment of the present invention.

FIG. 8 is a cross-sectional view of the cooling passage 7*c* according to a third embodiment of the present invention and corresponds to FIG. 3 of the first embodiment and FIG. 5 of the second embodiment. Although, for example, the blade suction side wall 20 is described, the present embodiment is also similar to the first embodiment in that slits are formed in the ribs at a predetermined angle to the flow direction 15 of the cooling air. However, the slits 71*b* and 71*a* of the present embodiment are formed such that rib pieces 33*b* and 33*a* at the side of the partition walls 6*b* and 6*c* among the plurality of rib pieces which are divided to have slant cross sections are displaced from the other rib pieces 32*b* and 32*a* toward the upstream side, similar to the second embodiment. In addition, similar to the second embodiment, it is preferable that the width 94 of the opening formed by the divided rib pieces is in a range of 0.5 times to 1.5 times of the width 92 of the divided rib piece.

In addition, similar to the first embodiment, it is preferable that the formation angles α and β of the slits 71*a* and 71*b* are in a range of 0 degree to 45 degrees. The angle α1 and α2 between the edges of the divided rib pieces and the flow direction 15 of the cooling air are not necessarily equal to each other. Similarly, the angles β1 and β2 are not necessarily equal to each other. The angles may different from each other.

By forming the ribs as described above, the same effect as that of the first embodiment, that is, effect that the flow passes through the slits to reduce the recirculation zone, and the same effect as that of the second embodiment, that is, the effect that the flow collides with the edges of the ribs displaced to the upstream side to improve the heat transfer, are obtained. Thus, it is possible to obtain higher heat transfer efficiency.

Figure 10:
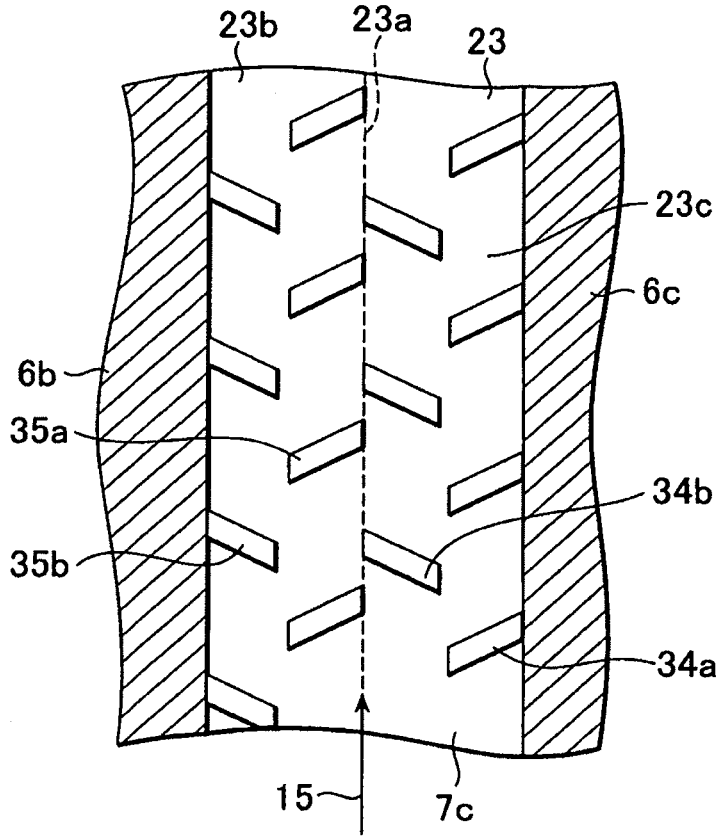
FIG. 10 is a cross-sectional view of a cooling passage according to a fourth embodiment of the present invention.

FIG. 10 is a cross-sectional view of the cooling passage 7*c* according to a fourth embodiment of the present invention and corresponds to FIG. 3 of the first embodiment. Even in the present embodiment, for example, the blade suction side wall 20 will be described. In the cooling passage 7*c*, a line on the back side cooling surface 23 indicating the center between the opposed wall surfaces is referred to as a center line 23*a*, a cooling surface at the side of the partition wall 6*b* of the center line 23*a* is referred to as a cooling surface 23*b*, and the cooling surface at the side of the partition wall 6*c* is referred to as a cooling surface 23*c*.

In the present embodiment, unlike the first embodiment, a first heat transfer rib 34*a* which extends from almost the center between the center line 23*a* and the partition wall 6*c* to the partition wall 6*c* and slants in the downstream direction of the cooling air and a second heat transfer rib 34*b* which extends from almost the center between the center line 23*a* and the partition wall 6*c* to the center line 23*a* and slants in the downstream direction of the cooling air are included. Furthermore, a third heat transfer rib 35*a* which extends from almost the center between the center line 23*a* and the partition wall 6*b* to the center line 23*a* and slants in the downstream direction of the cooling air and a fourth heat transfer rib 35*b* which extends from almost the center between the center line 23*a* and the partition wall 6*b* to the partition wall 6*b* and slants in the downstream direction of the cooling air are included. The ribs 34*a* and 34*b* of the cooling surface 23*c* are alternately arranged at the right and left sides from almost the center of the cooling surface 23*c* in a staggered manner and with different angles to the flow direction 15 of the cooling air. The ribs 35*a* and 35*b* of the cooling surface 23*b* are alternately arranged at the right and left sides from almost the center of the cooling surface 23*b* in a staggered manner and with different angles to the flow direction 15 of the cooling air. In other words, two rows of cooling ribs which are arranged in the staggered manner are arranged on the back side cooling surface 23.

Figure 11:
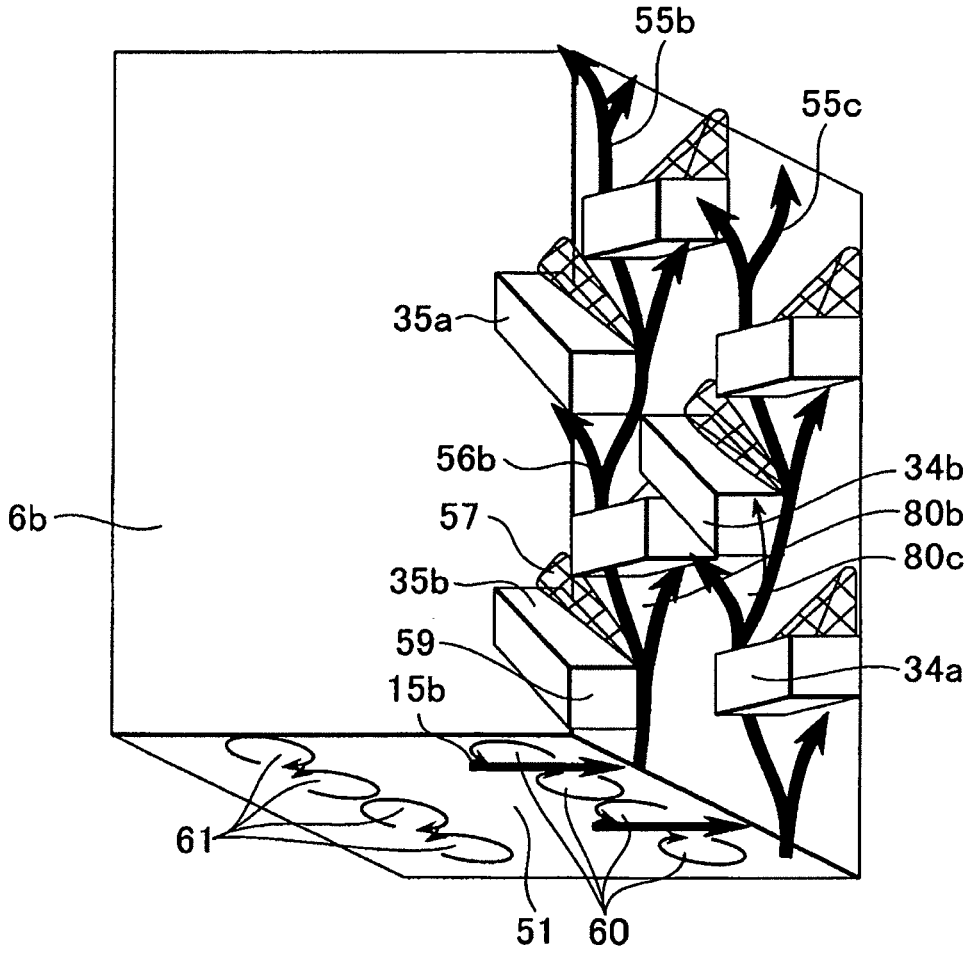
FIG. 11 shows air flow in the cooling passage of FIG. 10.

Next, the cooling air flow in the vicinities of the ribs 34*a*, 34*b*, 35*a*, and 35*b* in the cooling passage 7*c* according to the present embodiment will be described with reference to FIG. 11. In addition, in FIG. 11, the ribs provided on the opposed wall surfaces are not shown.

In the partition wall 6*b* which is a side wall of the passage and the center 51 of the passage, four pairs of secondary flows 60 and 61 are generated between the rib 34*a* and the rib 34*b* to be apart from the rib mounting surface and between the rib 35*a* and the rib 35*b* to be directed to the rib mounting surface. In the vicinity of the rib mounting surface, snaking flow 55*c* which runs in a space 80*c* between the rib 34*a* and the rib 34*b* and snaking flow 55 which runs in a space 80*b* between the rib 35*a* and the rib 35*b* are formed. In addition, flows 56*c* and 56*b* which are directed to the partition walls 6*c* and 6*b* along the upstream side of the ribs 34*a* and 35*b* are also formed. Furthermore, since air 15*b* having a low temperature in the center 51 of the passage becomes a turbulence flow caused by the snaking flows 55*b* and 55*c* by the secondary flow 60, heat transfer performance more increases in the vicinity of the center of the rib mounting surface.

In the present embodiment, plural rows of cooling ribs arranged in the staggered manner are arranged on the back side cooling surface 23. To this end, an area of the wall surface through which the snaking flow passes more increases, in comparison with the related art in which only a row of cooling ribs is arranged as shown in FIG. 9. Thus, the heat transfer coefficient is improved and thus heat efficiency of the gas turbine can increase.

In addition, although, in the present embodiment, the two rows of cooling ribs arranged in the staggered manner are arranged on the back side cooling surface 23, the number of the rows of the cooling ribs arranged in the staggered manner may be 3 or more.

Figure 12:
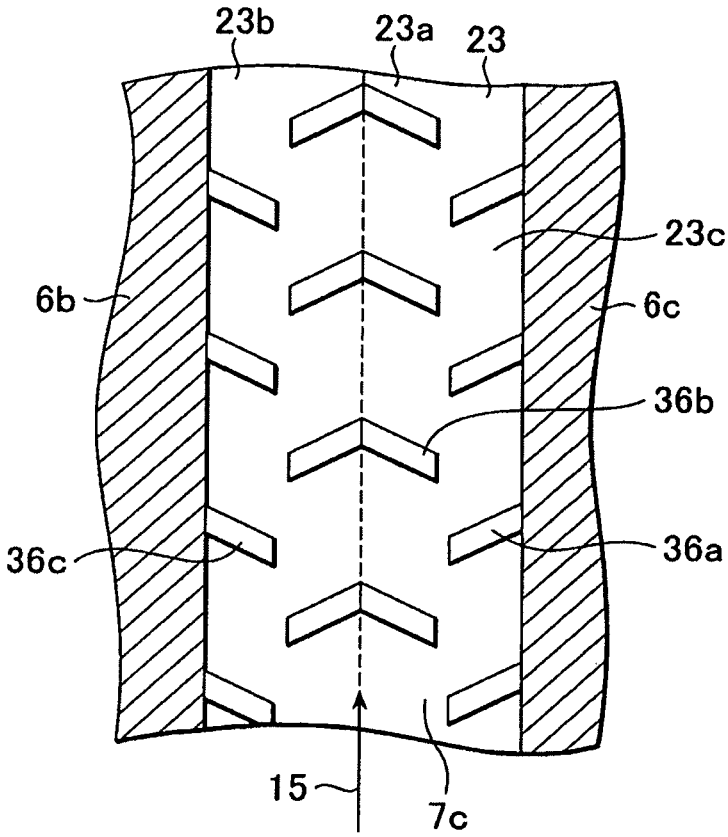
FIG. 12 is a cross-sectional view of a cooling passage according to a fifth embodiment of the present invention.

FIG. 12 is a cross-sectional view of the cooling passage 7*c* according to a fifth embodiment of the present invention and corresponds to FIG. 3 of the first embodiment. Even in the present embodiment, for example, the blade suction side wall 20 will be described.

The present embodiment is similar to the fourth embodiment shown in FIG. 10 in that the cooling air flow directions of the ribs 34*b* and 35*a* are equal to each other and is different from the fourth embodiment in that the ribs 34*a* and 35*a* are composed of the same member. In FIG. 12, a rib 36*b* corresponds to the ribs 34*b* and 35*a* of FIG. 10, a rib 36*a* corresponds to the rib 34*a* of FIG. 10, and a rib 36*c* corresponds to the rib 36*b* of FIG. 10. The other structures of FIG. 12 are similar to those of FIG. 10 and thus their description will be omitted.

In the present embodiment, by forming the ribs as described above, at the downstream side in the flow direction of the center of the rib 36*b*, air flowing along the rib is collected from the left and right sides to the center of the passage, collides with the rib 36*b*, and flows beyond the rib 36*b*. To this end, since the flow becomes stronger from the center of the passage to the rib mounting surface to make the secondary flow strong. Thus, it is possible to obtain higher heat transfer efficiency.

In addition, although, in the present embodiment, the cooling air flow directions of the rib 34*b* and the rib 35*a* are deviated from each other, the rib 34*b* and the rib 35*a* may be in contact with each other and two ribs may be composed of the same member.

In order to confirm the heat transfer effect of the fifth embodiment, model heat transfer experiments on the ribs in the related art shown in FIG. 9 and the ribs of the fifth embodiment were performed. Concretely saying, the heat transfer effects were compared under the shapes of the experimental models and experimental conditions shown in Table 2.

TABLE 2

| | ITEM | RELATED ART | FIFTH EMBODIMENT |
|---|---|---|---|
| RIB SHAPE | RIB HEIGHT | 4.9 mm | 4.9 mm |
| | RIB WIDTH | 4.9 mm | 4.9 mm |
| | RIB PITCH | 24.5 mm | 24.5 mm |
| | RIB ANGLE | γ 70° | γ 70° |
| | NUMBER OF ROWS | 1 | 2 |
| | PASSAGE WIDTH | 70 mm | 70 mm |
| | PASSAGE HEIGHT | 70 mm | 70 mm |
| EXPERIMENTAL CONDITIONS | MEDIUM | AIR | AIR |
| | EXPERIMENTAL RANGE (REYNOLDS NUMBER) | $3\sim6.5\times10^4$ | $3\sim6.5\times10^4$ |

In the experimental models, a rectangular passage having a passage height of 70 mm and a passage height of 70 mm was formed, the ribs shown in Table 2 were arranged on two opposed surfaces, air having a normal temperature flowed in the model passage, and one of the opposed surfaces was heated, and a temperature distribution of the heated surface was measured, thereby measuring the heat transfer coefficient.

Figure 13:
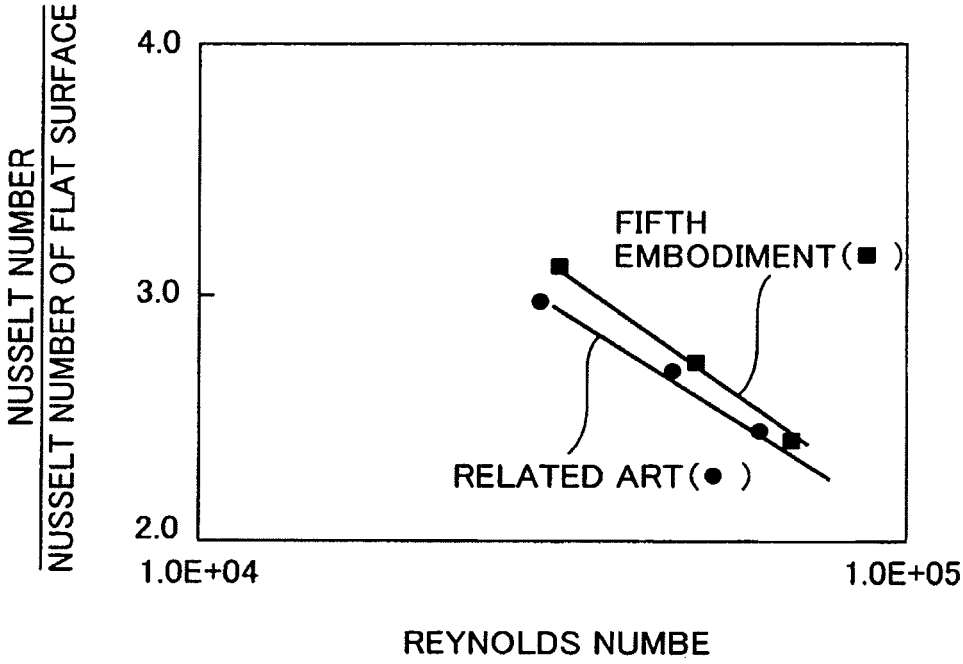
FIG. 13 shows experimental results of heat transfer characteristics.

FIG. 13 shows experimental results of heat transfer characteristics. The comparison was performed with the abscissa indicating the Reynolds numbers which express flow condition of the cooling air and the ordinate indicating a ratio of an average Nusselt number which expresses the flow condition of heat and an average Nusselt number of a flat surface. In FIG. 13, the larger the value on the ordinate, the more preferable the cooling performance is. In FIG. 13, the heat transfer performance of the structures relating to the fifth embodiment is clearly more preferable in comparison with the structure in the related art. Under the condition of Reynolds number of $6.5\times10^4$, which is close to the cooling air supply condition in rated gas turbine operation, the structure relating to the fifth embodiment has the higher heat transfer coefficient by about 6% in comparison with the related art, which is substantially equivalent to the second embodiment.

As described above, although the embodiments of the present invention are described, the number of the slits provided on the ribs and the number of the divisions is not limited to one. Even when the number of the slits provided on the ribs and the number of the divisions is plural, the similar effect can be obtained. Accordingly, the number of the slits provided on the ribs and the number of the divisions is not specially limited.

The uniform temperature distribution in a gas turbine blade 1 is preferable in view of the strength of the blade. On the other hand, the external thermal condition of the turbine blade differs depending on locations around the blade. Accordingly, in order to cool the blade to a uniform temperature distribution, rib structures for improvement of heat transfer at the suction side of the blade, the pressure side of the blade, and the partition wall are preferably designed to be matched to the external thermal condition. That is, concretely saying, the structure, the shape, and the arrangement of the ribs for the improvement of the heat transfer are selected from the ribs illustrated in the above-described embodiments or modified examples so as to match the requirement of each cooling surface.

The gas turbine has been hitherto taken as an example in the explanation, but the present invention is naturally applicable not only to the gas turbine but also to any members having internal cooling passages as previously described. In the above-described explanation, a return flow structure having two internal cooling passages is taken as an example, but the example does not give any restriction to number of cooling passages in application of the present invention. Furthermore, the explanation is performed with taking air as a cooling medium, but other medium such as steam etc. are naturally usable. The gas turbine blade adopting the structure relating to the present invention has a simple construction and, accordingly, the blade can be manufactured by current precision casting.

What is claimed is:

1. A member having an internal cooling passage formed therein and having opposed wall surfaces between which a medium flows to cool a parent material, comprising a first rib which extends from almost the center between the opposed wall surfaces to one wall surface and slants in a downstream direction of the medium, and a second rib which extends from almost the center between the opposed wall surfaces to the other wall surface and slants in the downstream direction of the medium, wherein an opening which passes through between an upstream side of the cooling passage and a downstream side of thereof is formed in the first rib or the second rib, and wherein the opening deflects the flow of the medium to the wall surfaces.

2. The member according to claim 1, wherein the first rib and the second rib are arranged in a staggered manner.

3. The member according to claim 2, wherein the opening is formed of a slit.

4. The member according to claim 2, wherein the opening is provided in the vicinity of the wall surface rather than the center of the first rib or the second rib.

5. A member having an internal cooling passage formed therein and having opposed wall surfaces between which a medium flows to cool a parent material, comprising a first rib which extends from almost the center between the opposed wall surfaces to one wall surface and slants in a downstream direction of the medium, and a second rib which extends from almost the center between the opposed wall surfaces to the other wall surface and slants in the downstream direction of the medium, wherein the first rib or the second rib includes a plurality of divided rib pieces, and the width of each of openings formed by the rib pieces is in a range of 0.5 times to 1.5 times of the width of each of the rib pieces, and wherein the opening deflects the flow of the medium to the wall surfaces.

6. A member having an internal cooling passage formed therein and having opposed wall surfaces between which a medium flows to cool a parent material, comprising a first rib which extends from almost the center between the opposed wall surfaces to one wall surface and slants in a downstream direction of the medium, and a second rib which extends from almost the center between the opposed wall surfaces to the other wall surface and slants in the downstream direction of the medium, wherein the first rib or the second rib includes a plurality of divided rib pieces, the rib pieces at the sides of the wall surfaces are placed at an upstream side of the medium relative to the rib pieces at the side of the center between the opposed wall surfaces, and the medium colliding with the edges of the rib pieces at the side of the wall surfaces flows to a downstream side of the rib pieces at the sides of the wall surfaces through openings formed between said plurality of divided rib pieces, and wherein the opening deflects the flow of the medium to the wall surfaces.

7. A member having an internal cooling passage formed therein and having a rib mounting surface on which a rib is provided and along which a medium flows to cool a parent material, wherein the rib comprises a first rib which extends from a first position of the rib mounting surface in a flow direction of the medium and has a length in the direction toward one of the side edges of the rib mounting surface, and a second rib which extends from a second position of the rib mounting surface in the flow direction of the medium and has a length in the direction toward the other side edge of the rib mounting surface, wherein each of the first rib and the second rib has a slit which is a gap in a lengthwise direction of the rib, and wherein the gaps deflect the flow of the medium to the first and second side edges of the rib mounting surface.

8. A member having an internal cooling passage formed therein and having a rib mounting surface on which a rib is provided and along which a medium flows to cool a parent material, wherein the rib comprises a first rib which extends from a first position of the rib mounting surface in a flow direction of the medium and has a length in the direction toward one of the side edges of the rib mounting surface, and a second rib which extends from a second position of the rib mounting surface in the flow direction of the medium and has a length in the direction toward the other side edge of the rib mounting surface, and the first rib or the second rib includes a plurality of divided rib pieces, the plurality of rib pieces which form one rib being arranged to form an opening which is a gap in a width direction of the rib and the width of each of the openings being in a range of 0.5 times to 1.5 times of the width of each of the rib pieces, wherein the gaps deflect the flow of the medium to the first and second side edges of the rib mounting surface.

9. The member according to claim 8, wherein the plurality of rib pieces which form one rib are arranged to form a gap in the lengthwise direction of the rib.

* * * * *